US010619869B2

(12) United States Patent
Li et al.

(10) Patent No.: US 10,619,869 B2
(45) Date of Patent: Apr. 14, 2020

(54) AIR HUMIDIFYING DEVICE AND METHOD OF MOVING THE SAME, AIR HUMIDIFYING SYSTEM AND CONTROL METHOD THEREOF, AND MONITORING SYSTEM

(71) Applicant: BOE TECHNOLOGY GROUP CO., LTD., Beijing (CN)

(72) Inventors: Yue Li, Beijing (CN); Haijun Su, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 266 days.

(21) Appl. No.: 15/546,166

(22) PCT Filed: Feb. 8, 2017

(86) PCT No.: PCT/CN2017/073111
§ 371 (c)(1),
(2) Date: Jul. 25, 2017

(87) PCT Pub. No.: WO2017/185852
PCT Pub. Date: Nov. 2, 2017

(65) Prior Publication Data

US 2018/0216839 A1 Aug. 2, 2018

(30) Foreign Application Priority Data

Apr. 28, 2016 (CN) ..... 2016 1 0279989

(51) Int. Cl.
*F24F 6/12* (2006.01)
*F24F 11/89* (2018.01)
(Continued)

(52) U.S. Cl.
CPC ..... *F24F 6/12* (2013.01); *F24F 6/00* (2013.01); *F24F 11/63* (2018.01); *F24F 11/70* (2018.01);
(Continued)

(58) Field of Classification Search
CPC ..... F24F 6/00; F24F 6/12; F24F 11/63; F24F 11/70; F24F 11/89; F24F 2110/20; F24F 2221/12; F24F 2221/42
(Continued)

(56) References Cited

U.S. PATENT DOCUMENTS 6,408,226 B1 * 6/2002 Byrne ..... G05D 1/0246 318/568.11
6,879,878 B2 * 4/2005 Glenn ..... B25J 9/1689 318/568.11
(Continued)

FOREIGN PATENT DOCUMENTS

CN 102638863 A 6/2012
CN 203132037 U 8/2013
(Continued)

OTHER PUBLICATIONS

Search Report and Written Opinion dated May 9, 2017 from State Intellectual Property Office of the P.R. China.
Chinese Office Action dated Jul. 5, 2018.

*Primary Examiner* — Charles S Bushey
(74) *Attorney, Agent, or Firm* — Dilworth & Barrese, LLP; Michael J. Musella, Esq.

(57) ABSTRACT

An air humidifying device and a moving method thereof, an air humidifying system and a control method thereof, and a monitoring system are disclosed. The moving method includes: determining a target region to be humidified, the target region being any one of N to-be-humidified regions, and N being an integer greater than or equal to 2; determining movement trace information of the air humidifying
(Continued)

device moving towards the target region; moving to the target region according to the movement trace information; and humidifying the target region. The method is used in a humidifying process of the air humidifying device, which not only expands the scope of air humidification, but also makes the air humidifying device move flexibly.

20 Claims, 6 Drawing Sheets

(51) Int. Cl.

| | |
|---|---|
| ***F24F 6/00*** | (2006.01) |
| ***F24F 11/63*** | (2018.01) |
| ***F24F 11/70*** | (2018.01) |
| *F24F 110/20* | (2018.01) |

(52) U.S. Cl.
CPC ..... *F24F 11/89* (2018.01); *F24F 2110/20* (2018.01); *F24F 2221/12* (2013.01); *F24F 2221/42* (2013.01)

(58) Field of Classification Search
USPC ..... 261/26, 78.2, 115, 129, 135
See application file for complete search history.

(56) References Cited

U.S. PATENT DOCUMENTS

| | | | | |
|---|---|---|---|---|
| 8,755,936 | B2 * | 6/2014 | Friedman ..... | G08C 17/00 700/248 |
| 2006/0149465 | A1 | 7/2006 | Park et al. | |
| 2016/0202712 | A1 | 7/2016 | Chan | |

FOREIGN PATENT DOCUMENTS

| | | | |
|---|---|---|---|
| CN | 103528137 | A | 1/2014 |
| CN | 103607763 | A | 2/2014 |
| CN | 104321711 | A | 1/2015 |
| CN | 204285733 | U | 4/2015 |
| CN | 204314269 | U | 5/2015 |
| CN | 105509209 | A | 4/2016 |
| CN | 105928143 | A | 9/2016 |
| KR | 20150097052 | A | 8/2015 |
| WO | 2010129232 | A1 | 11/2010 |

* cited by examiner

AIR HUMIDIFYING DEVICE AND METHOD OF MOVING THE SAME, AIR HUMIDIFYING SYSTEM AND CONTROL METHOD THEREOF, AND MONITORING SYSTEM

TECHNICAL FIELD

Embodiments of the present disclosure relate to a field of intelligent electrical appliance technology, and particularly, to an air humidifying device and a method of moving the same, an air humidifying system and a control method thereof, and a monitoring system.

BACKGROUND

An air humidifying device is one of the most commonly used appliances in daily life; with an ultrasonic air humidifying device as an example, by using an ultrasonic-high-frequency-oscillation, it transforms water mist into ultrafine particles of 1-5 micrometers and sprays the same into the air, so as to refresh the air, and create a comfortable environment.

An existing air humidifying device uses a humidity sensor mounted on itself to monitor and adjust indoor air humidity or detects a water level height; however, such an air humidifying device is mostly a device fixed in one position, which can only spray and humidify in a position where it is placed; due to limitation of the location, a scope of its humidification coverage is very limited, which cannot effectively humidify an entire room, and thus, it is difficult to achieve a desired humidification effect.

SUMMARY

Embodiments of the present disclosure provide an air humidifying device and a method of moving the same, an air humidifying system and a control method thereof, and a monitoring system, which can expand the scope of air humidification, to ensure humidity balance of the indoor air.

In first aspect of the present disclosure, it is provided a method of moving an air humidifying device, comprising: determining a target region, the target region being any one of N to-be-humidified regions, and N being an integer greater than or equal to 2; determining movement trace information of the air humidifying device moving towards the target region; moving the air humidifying device to the target region according to the movement trace information; and humidifying the target region.

In second aspect of the present disclosure, it is provided an air humidifying device, comprising: a determining unit, configured for determining a target region, and determining movement trace information of the air humidifying device moving towards the target region, the target region being any one of N to-be-humidified regions, and N being an integer greater than or equal to 2; a moving unit, configured for moving the air humidifying device to the target region according to the movement trace information; and a humidifying unit, configured for humidifying the target region.

In third aspect of the present disclosure, it is provided a monitoring system for an air humidifying system, wherein the air humidifying system comprises an air humidifying device, the monitoring system comprises N monitoring nodes, N being an integer greater than or equal to 2, each monitoring node comprising: a position determining unit, configured for receiving a positioning instruction transmitted by the air humidifying device, and determining relative position information with respect to the air humidifying device, the positioning instruction carrying a region identifier of the target region; a transmitting unit, configured for transmitting the relative position information to the air humidifying device, so that the air humidifying device, according to the relative position information, determines one of the N monitoring nodes as a movement management node; and transmitting the movement trace information to the air humidifying device; a trace determining unit, configured for determining the movement trace information of the air humidifying device moving towards the target region, according to the region identifier of the target region and the relative position information, if the monitoring node is the movement management node.

In fourth aspect of the present disclosure, it is provided an air humidifying system, comprising the above-mentioned air humidifying device and the above-mentioned monitoring system, the N monitoring nodes being respectively located in the N to-be-humidified regions.

In fifth aspect of the present disclosure, it is provided control method for the air humidifying system according to claim 14, comprising: determining relative position information between the first monitoring node and the air humidifying device, if the first monitoring node receives the transmitted positioning instruction, the positioning instruction carrying the region identifier of the target region, the first monitoring node is any one of the N monitoring nodes; transmitting the relative position information between the first monitoring node and the air humidifying device to the air humidifying device, and determining one of the N monitoring nodes as a movement management node, according to the relative position information; determining movement trace information of the air humidifying device moving towards the target region, according to the region identifier of the target region and the relative position information, if the first monitoring node is the movement management node, and transmitting the movement trace information to the air humidifying device.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
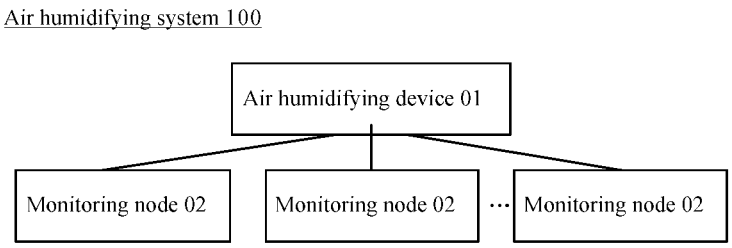
FIG. 1 is a block diagram of an air humidifying system provided by an embodiment of the present disclosure.

Embodiments of the present disclosure provide an air humidifying device and a method of moving the air humidifying device, and an air humidifying system and a control method thereof. As illustrated in FIG. 1, an air humidifying system 100 comprises an air humidifying device 01 and N monitoring nodes 02, the N monitoring nodes 02 being respectively located in N regions to be humidified.

Each monitoring node 02 is configured for monitoring humidity in the region where it is located, and transmits monitored humidity to the air humidifying device 01, so that the air humidifying device 01 determines a target region to be humidified according to the humidity transmitted by each monitoring node 02.

In addition, the monitoring node 02 is further configured for positioning the air humidifying device 01, to obtain a relative position information with respect to the air humidifying device 01, and transmits the relative position information to the air humidifying device 01, so that the air humidifying device 01 determines movement trace information according to the relative position information in case that the air humidifying device 01 moves towards the target region.

Figure 2:
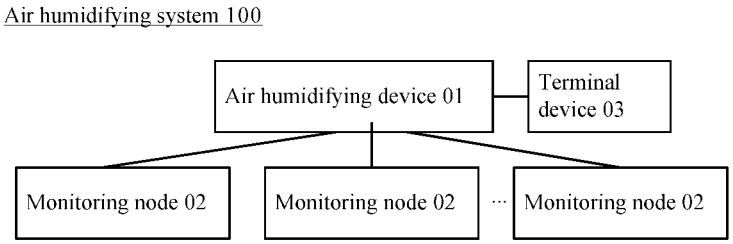
FIG. 2 is a block diagram of an air humidifying system provided by another embodiment of the present disclosure.

In at least some of embodiments, as illustrated in FIG. 2, the air humidifying system 100 further comprise a terminal device 03, for example, a mobile phone or a tablet personal computer. The terminal device 03 may perform wirelessly transmission with the air humidifying device 01, for example, the terminal device 03 transmits a humidification instruction to the air humidifying device 01 through Wireless Fidelity (WIFI). The humidification instruction includes, for example, a region identifier of the target region to be humidified; thus, the air humidifying device 01 can determine the target region to be humidified according to the region identifier of the target region, so as to implement remote control of the air humidifying device 01 by the terminal device 03.

Figure 3:
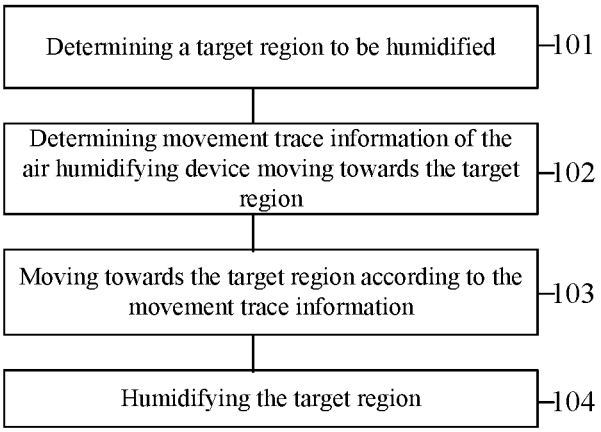
FIG. 3 is a flow chart of a method of moving an air humidifying device provided by an embodiment of the present disclosure.

According to the air humidifying system 100 illustrated in FIG. 1 or FIG. 2, an embodiment of the present disclosure provides a method of moving the air humidifying device 01, and as illustrated in FIG. 3, the method comprises:

101: determining a target region to be humidified (the target region is, for example, any one of the N regions to be humidified);

102: determining movement trace information of the air humidifying device moving towards the target region;

103: moving to the target region according to the movement trace information; and

104: humidifying the target region.

For example, in step 101, since the humidification instruction transmitted from the terminal device carries a region identifier of the target region to be humidified, the air humidifying device may determine the target region to be humidified according to the humidification instruction.

Alternatively, since each of the above-described N monitoring nodes is configured for detecting humidity in respective N regions where it is located, and transmit the monitored humidity to the air humidifying device, when the humidity transmitted by a certain monitoring node is less than a humidity threshold, the air humidifying device may determine that the region where the monitoring node is located is the target region to be humidified. Further, in step 102, the movement trace information of the air humidifying device moving towards the target region is determined.

For example, the air humidifying device stores the relative position information between it and the N humidified regions, in addition, the air humidifying device has a positioning function. When the air humidifying device determines the target region to be humidified, the air humidifying device may activates a positioning function to determine a specific position where it is located within the N humidified regions, and then the movement trace information between the air humidifying device and the target region can be determined in combination with the above-described relative position information of the N humidified regions.

Next, in step 103, the air humidifying device moves according to the movement trace information, until it arrives at the target region.

For example, the movement trace information may be trace information of moving from a current position to the target region, and at this time, the step 102 and the step 103 are respectively executed once, so that the air humidifying device may arrive at the target region.

If a trace from the current position to the target region is a straight line, the movement trace information may include a moving direction and a moving distance of the air humidifying device moving to the target region. If the trace from the current position to the target region is a polyline composed of a plurality of straight segments, the movement trace information may include: information on each straight segment, for example, a moving direction and a moving distance of the air humidifying device moving towards the target region in each straight segment.

Alternatively, the air humidifying device may repeatedly execute the step 102 and the step 103 several times so as to arrive at the target region, and at this time, the movement trace information in each repetition indicates a moving trace of the air humidifying device from the current position to a next position, which is not necessarily the movement trace information of the air humidifying device from the current position to the target region, and the movement trace information may include, for example, the moving direction and the moving distance of the air humidifying device moving towards the target region.

For example, the movement trace information indicates that the moving direction of the air humidifying device is due north, and the moving distance is 1 meter, after the air humidifying device moves in direction of due north for 1 meter according to the movement trace information, it may not have arrived at the target region. At this time, the air humidifying device may repeat the above-described steps of determining movement trace information of moving towards the target region and moving according to the movement trace information, until the air humidifying device arrives at the target region.

Finally, in step 104, when the air humidifying device arrives at the target region to be humidified, the air humidifying device may activate the humidification function to humidify the target region. It can be understood that, the humidification method of the air humidifying device is not limited in the embodiment of the present disclosure, for example, the humidifying method may be ultrasonic humidification, electric heating humidification, and the like.

It can be seen that, the air humidifying device is guided to move towards the target region to be humidified and then activate the humidification function, which can avoid a problem of limited humidified region caused by fixed humidification position, and can expand the scope of air humidification, to ensure humidity balance of the indoor air.

Figure 4:
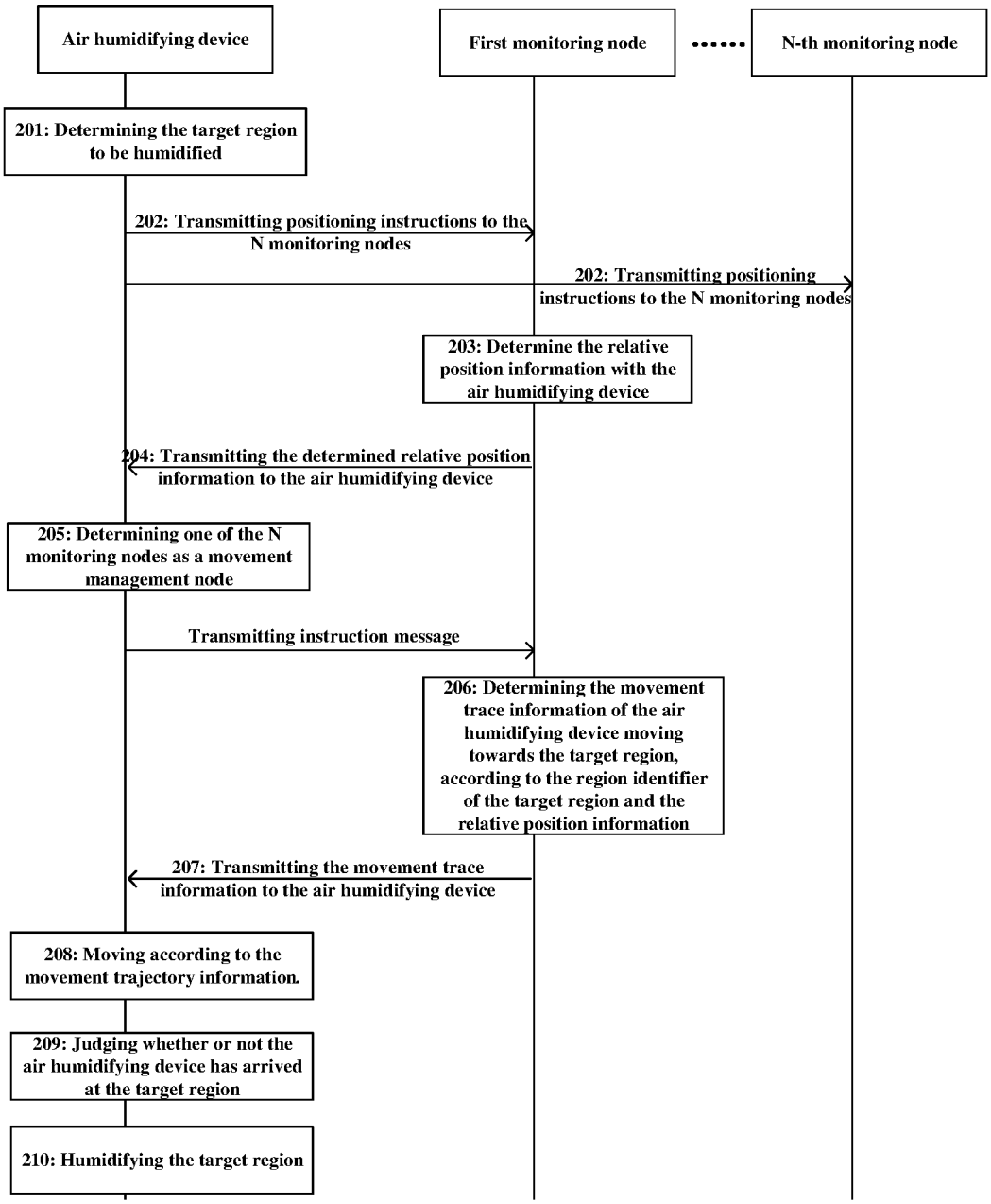
FIG. 4 is an interactive schematic diagram of a control method of an air humidifying system provided by an embodiment of the present disclosure.

In one example, the method of moving the air humidifying device, as illustrated in FIG. 4, comprises:

201: determining a target region to be humidified (the target region is, for example, any one of N regions to be humidified);

202: transmitting positioning instructions to N monitoring nodes, each positioning instruction carrying a region identifier of the target region;

203: determining relative position information between each monitoring node and the air humidifying device;

204: transmitting the relative position information to the air humidifying device;

205: determining one of the N monitoring nodes as a movement management node according to the received relative position information;

206: if a first monitoring node is the movement management node, wherein the first monitoring node is any one of N monitoring nodes, determining, by the first monitoring node, the movement trace information of the air humidifying device moving towards the target region, according to the region identifier of the target region and the relative position information.

207: transmitting the movement trace information to the air humidifying device by the first monitoring node;

208: moving the air humidifying device according to the movement trace information;

209: judging whether or not the air humidifying device has arrived at the target region: if the air humidifying device arrives at the target region, executing step 210; if not, repeatedly executing steps 202 to 209;

210: humidifying the target region.

For example, the step 201 of determining the target region to be humidified may refer to the description of step 101, so it is not elaborated here.

In step 202, when the target region to be humidified is determined, since the air humidifying device cannot detect its own position, the air humidifying device may transmit a positioning instruction to the N monitoring nodes, respectively, the positioning instruction carrying the region identifier of the target region.

Next, in step 203, the monitoring node receiving the positioning instruction, e.g., the first monitoring node, determines the relative position information between itself and the air humidifying device.

For example, the relative position information refers to: coordinates of the air humidifying device in a first rectangular coordinate system, in condition that the first rectangular coordinate system using the first monitoring node as an origin is established. Alternatively, the relative position information may refer to: coordinates of the air humidifying device in a second rectangular coordinate system and coordinates of the first monitoring node in the second rectangular coordinate system, in condition that the second rectangular coordinate system using any position as an origin is established.

For example, by taking the first monitoring node as an example, the first monitoring node collects environmental data in a first region where it is located, and then, extracts preset characteristic information of the air humidifying device from the environmental data (the characteristic information of air humidifying device includes, for example, an identification characteristic of the air humidifying device). For example, when the characteristic information of the air humidifying device is circular characteristic of the air humidifying device which is a circle of a specified size, the first monitoring node may first extract all of circular characteristic information in the above-described environmental data, and then search for a circle having the same size as the circle of the specified size in the above-described circular characteristic information. If the circle with same size is found, it indicates that there is an object with the circular characteristic in the environmental data, that is, the air humidifying device, at this time, the first monitoring node calculates the relative position information between the first monitoring node and the air humidifying device.

If the circle with same size is not found, it indicates that there is no air humidifying device in the first region, and the first monitoring node will not determine the relative position information between the first monitoring node and the air humidifying device.

Figure 5:
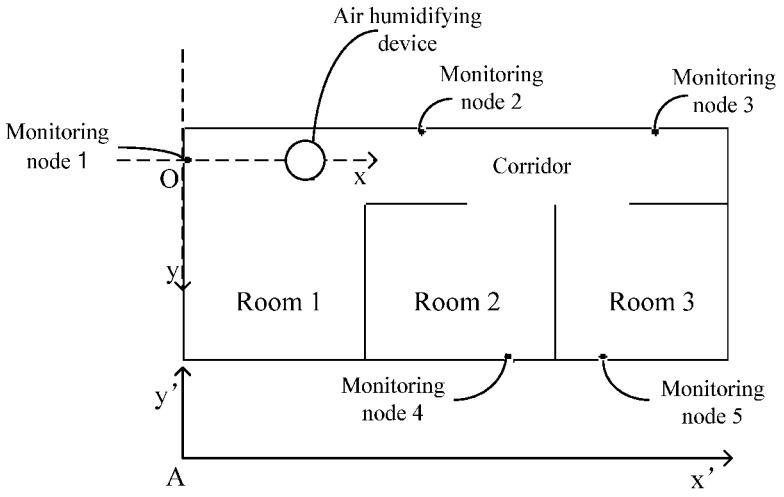
FIG. 5 is an application scenario schematic diagram of an air humidifying system provided by an embodiment of the present disclosure.

As illustrated in FIG. 5, a user's house is provided therein with an air humidifying system, wherein, a monitoring node 1 is provided in Room 1, a monitoring node 2 and a monitoring node 3 are respectively provided at both ends of a corridor, a monitoring node 4 is provided in Room 2, and a monitoring node 5 is provided in Room 3. If Room 3 is the target region, the air humidifying device transmits positioning instructions to the monitoring nodes 1 to 5 respectively; with the monitoring node 1 as an example, after the monitoring node 1 receives the positioning instruction, it determines the relative position information between itself and the air humidifying device.

For example, the monitoring node 1 is provided with a micro-steering gear and an infrared distance measurement sensor which are coaxially rotated. When the micro-steering gear is rotated, a rotation angle of the infrared distance measurement sensor which is coaxially rotated with the micro-steering gear may be recorded; in addition, when the micro-steering gear is rotated, the information of distance between the monitoring node 1 and an obstacle in front of the monitoring node 1 at the rotation angle may be collected by the infrared distance measurement sensor. Since rotation of the micro-steering gear is continuous, the monitoring node 1 collects information of a plurality of sets of rotation angles and distances within one rotation period by using the above-described method, at this time, the monitoring node 1 may, according to the plurality of sets of rotation angles and distances within one rotation period, generate the environmental data of the humidified region where the monitoring node 1 is located.

For example, the environmental data includes shape information and size information of each object in the humidified region, as well as distance information and a rotation angle of each object with respect to the monitoring node 1.

The monitoring node 1 can extract preset characteristic information of the air humidifying device from the above-described environmental data. For example, a noise data point in the environmental data is first eliminated by using a median-filter algorithm, and then, clustering analysis is performed by using a nearest neighbor algorithm, that is, the de-noised environmental data is categorized, such that the characteristic information of a preset shape is extracted, for example, the characteristic information of the circular shape is extracted. At this time, if the characteristic information of the circular shape has a size same as a pre-stored size of the humidifier, it indicates that the object indicated by the characteristic information is the air humidifying device.

Since the monitoring node 1 has collected the environmental data including the above-described air humidifying device, the monitoring node 1 can calculate the relative position information between the monitoring node 1 and the air humidifying device according to the environmental data. For example, the monitoring node 1 can, according to an extended Kalman-filter algorithm, derive a first position coordinate of the air humidifying device with respect to the monitoring node 1. For example, as illustrated in FIG. 5, a first rectangular coordinate system with a Point O where the monitoring node 1 is located as an origin is established. At this time, the air humidifying device is located at a position which is in a direction of the due north of the monitoring node 1 and has a distance of 1 meter from the monitoring node 1, that is, the first position coordinate is (1, 0), which may be used as the above-described relative position information. Still as illustrated in FIG. 5, a second rectangular coordinate system with Point A as an origin is also established. At this time, the above-described relative position information includes the coordinate (0, 3) of the monitoring node 1 in the second rectangular coordinate system and the coordinate (1, 3) of the air humidifying device in the second rectangular coordinate system.

It can be contemplated that the monitoring node 1 may be further provided with a magnetometer to perform coordinate transformation on the first position coordinate in the above-described first rectangular coordinate system, so as to obtain the position coordinate of the air humidifying device in the second rectangular coordinate system. Still as illustrated in FIG. 5, when the air humidifying device is located at the position which is in a direction of the due north of the monitoring node 1 and has a distance of 1 meter from the monitoring node 1, the second position coordinate of the air humidifying device after coordinate transformation is (1, 3).

Other monitoring nodes receiving the above-described positioning instruction, e.g., the monitoring node 2 in FIG. 5, may also determine the relative position information between themselves and the air humidifying device according to the above-described method.

In step 204, the determined relative position information is transmitted to the air humidifying device, the first monitoring node is any one of the N monitoring nodes.

In this way, the air humidifying device can obtain all the relative position information transmitted by the monitoring nodes which communicate with the air humidifying device.

Since the air humidifying device neither knows a specific location of its own, nor knows a specific location of the target region, in step 205, the air humidifying device may, according to the received relative position information, determine one of the N monitoring nodes as a movement management node for the air humidifying device, so as to obtain the movement trace information of moving towards the target region, from the movement management node.

For example, the air humidifying device, according to the position information transmitted by one or more monitoring nodes, takes the monitoring node closest to the air humidifying device as the above-described movement management node. For example, although both the monitoring node 1 and the monitoring node 2 in FIG. 5 transmit relative position information to the air humidifying device, the monitoring node 1 is taken as the movement management node, because the monitoring node 1 is closest to the air humidifying device. At this time, the air humidifying device may transmit an instruction message to the monitoring node 1, to trigger the monitoring node 1 to execute step 206 as described below.

In step 206, if the first monitoring node is the movement management node, the first monitoring node determines the movement trace information of the air humidifying device moving towards the target region, according to the relative position information between itself and the air humidifying device determined in step 203 and the region identifier of the target region carried in the positioning instruction.

For example, the N monitoring nodes are networked by using ZigBee protocol, or other protocols, so that location and information sharing among the N monitoring nodes can be implemented. If the region identifier of the above-described target region is not same as the region identifier of the region where the first monitoring node is located (i.e., the first region), it indicates that the region where the air humidifying device is currently located is not the target region, and the air humidifying device needs to move out from the current first region and moves towards the target region. At this time, the first monitoring node serving as the movement management node may, according to the above-described relative position information, determine an outlet where the air humidifying device is close to the target region within the first region. For example, according to the relative position information between the monitoring node 1 and the air humidifying device, the monitoring node 1 serving as the movement management node in FIG. 5 determines an outlet from Room 1 to the corridor within the humidified region of the monitoring node 1 as the outlet where the air humidifying device is close to Room 3 (i.e., the target region).

At this time, the monitoring node 1 takes a distance and a direction of the air humidifying device with respect to the above-described outlet as the movement trace information, i.e., the first monitoring node takes the distance and the direction of the air humidifying device with respect to the above-described outlet as the movement trace information.

For example, the first monitoring node may further monitor the relative position information between the first monitoring node and the air humidifying device in real time, and transmit the relative position information to the air humidifying device, so that the air humidifying device determines its own position.

Further, in step 207, the first monitoring node transmits the movement trace information to the air humidifying device.

In step 208, the air humidifying device moves according to the movement trace information.

In step 209, it is necessary to judge whether or not the air humidifying device has arrived at the target region; if it arrives at the target region, the step 209 is performed, and if it does not arrive at the target region, the steps 202 to 209 are repeatedly executed.

Still with FIG. 5 as an example, when the air humidifying device moves and arrives at the outlet of Room 1 lead to the corridor, respective monitoring nodes may again locate the air humidifying device. If it is determined that the air humidifying device arrives at the target region, a first trigger instruction is transmitted to the air humidifying device, so as to trigger the air humidifying device to execute step 209 as described below, i.e., to humidify the target region.

If it is determined that the air humidifying device does not arrive at the target region, a second trigger instruction is transmitted to the air humidifying device, so as to trigger the air humidifying device to repeatedly execute steps 202 to 209, i.e., to determine again the movement management node at this time, and to obtain a new movement trace information from the movement management node again, so that the air humidifying device moves according to the new movement trace information, until it arrives at the target region.

Finally, in step 210, after the air humidifying device arrives at the target region to be humidified, the humidification function of the air humidifying device is activated to humidify the target region.

So far, the embodiment of the present disclosure provides a method of moving the air humidifying device. The air humidifying device can move towards the target region, and then activate the humidification function, which can avoid a problem of limited humidified region and expand the scope of air humidification, so as to ensure humidity balance of the indoor air.

Figure 6:
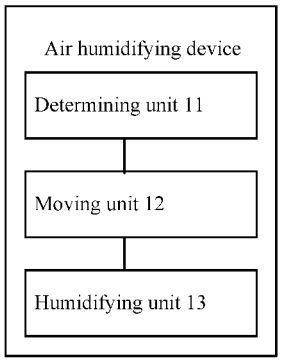
FIG. 6 is a block diagram of an air humidifying device provided by an embodiment of the present disclosure.

FIG. 6 is a structural schematic diagram of an air humidifying device provided by an embodiment of the present disclosure. The air humidifying device comprises:

a determining unit 11, configured for determining a target region to be humidified and determining movement trace information of the air humidifying device moving towards the target region, the target region being any one of N regions, and N being an integer greater than or equal to 2;

a moving unit 12, configured for moving to the target region according to the movement trace information;

a humidifying unit 13, configured for humidifying the target region.

Figure 7:
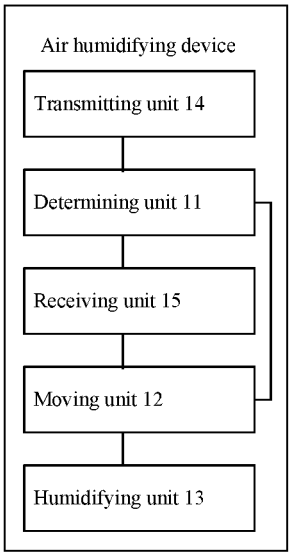
FIG. 7 is a block diagram of an air humidifying device provided by another embodiment of the present disclosure.

For example, a monitoring node is provided in each of the N regions to be humidified. For example, as illustrated in FIG. 7, the air humidifying device further comprises a transmitting unit 14 and a receiving unit 15, wherein the transmitting unit 14 is configured for transmitting positioning instructions to the N monitoring nodes, each of the positioning instructions carrying a region identifier of the target region. The determining unit 11 is further configured for determining one of the N monitoring nodes as a movement management node for the air humidifying device according to relative position information. The receiving unit 15 is configured for receiving relative position information with respect to the air humidifying device transmitted by the N monitoring nodes and receiving the movement trace information transmitted by the movement management node.

In at least some of embodiments, the determining unit 11 is configured for, according to the relative position information, taking a monitoring node closest to the air humidifying device as the movement management node.

In at least some of embodiments, the receiving unit 15 is further configured for receiving a humidification instruction of an external terminal device, the humidification instruction including the region identifier of the target region;

The determining unit 11 is further configured for determining the target region to be humidified, according to the region identifier of the target region.

Figure 8:
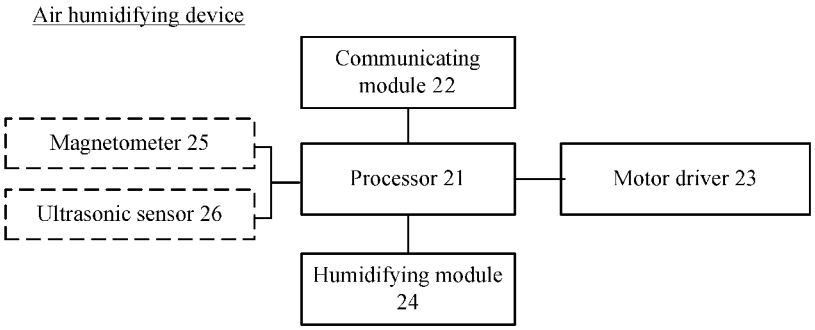
FIG. 8 is a block diagram of an air humidifying device provided by yet another embodiment of the present disclosure.

Exemplarily, FIG. 8 is a hardware design solution of the air humidifying device, wherein the air humidifying device comprises:

a processor 21, for example, an Advanced RISC Machines (ARM) processor, for executing relevant functions of the above-described determining unit 11;

a communicating module 22, for example, a ZigBee communicating module and a WiFi module, for executing relevant functions of the transmitting unit 14 and the receiving unit 15 as described above;

a motor driver 23, for executing relevant functions of the above-described moving unit 12;

a humidifying module 24, for example, an ultrasonic humidifying module, for executing relevant functions of the above-described humidifying unit 13.

Optionally, the air humidifying device may further comprise a hardware device such as a magnetometer 25 and an ultrasonic sensor 26. For example, the magnetometer 25 performs coordinate transformation on the position coordinate transmitted by the monitoring node, and the ultrasonic sensor 26 senses obstacles surrounding the air humidifying device, so that the air humidifying device avoids the obstacles when moving.

Figure 9:
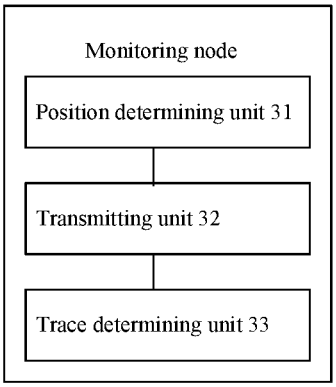
FIG. 9 is a block diagram of a monitoring node provided by an embodiment of the present disclosure.

An embodiment of the present disclosure further provides a monitoring system for an air humidifying system, the system comprising N monitoring nodes, N being an integer greater than or equal to 2. FIG. 9 is a structural schematic diagram of a monitoring node provided by an embodiment of the present disclosure. Each monitoring node comprises:

a position determining unit 31, configured for receiving a positioning instruction transmitted by the air humidifying device, and determining relative position information with the air humidifying device, the positioning instruction carrying a region identifier of a target region;

a transmitting unit 32, configured for transmitting the relative position information to the air humidifying device, so that the air humidifying device, according to the relative position information, determines one of the N monitoring nodes as a movement management node for the air humidifying device; and transmitting the movement trace information to the air humidifying device;

a trace determining unit 33, configured for determining the movement trace information of the air humidifying device moving towards the target region, according to the region identifier of a target region and the relative position information, if the monitoring node is the movement management node.

Figure 10:
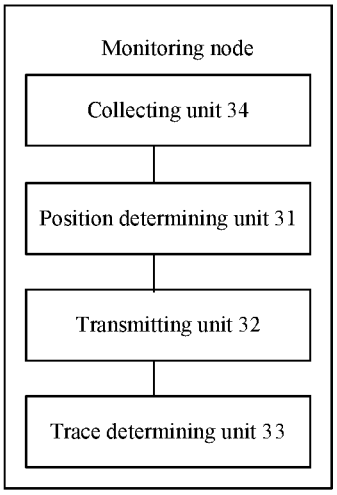
FIG. 10 is a block diagram of a monitoring node provided by another embodiment of the present disclosure.

In at least some of embodiments, as illustrated in FIG. 10, the monitoring node further comprises a collecting unit 34;

The collecting unit 34 is configured for collecting environmental data in a first region, the first monitoring node being located in the first region;

As an example, the position determining unit 31 is configured for: determining relative position information between the first monitoring node and the air humidifying device according to the environmental data, if characteristic information of the air humidifying device is extracted from the environmental data, the characteristic information of the air humidifying device including an identification characteristic of the air humidifying device.

Figure 11:
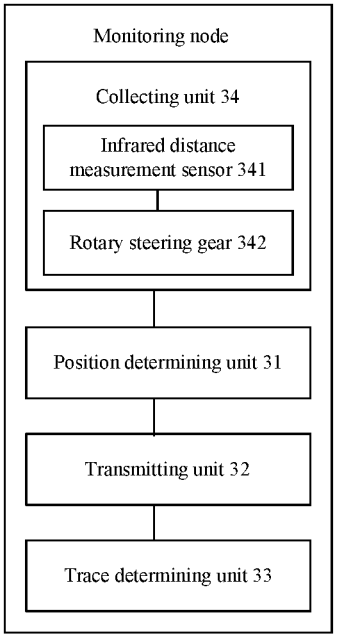
FIG. 11 is a block diagram of a monitoring node provided by yet another embodiment of the present disclosure.

In at least some of embodiments, as illustrated in FIG. 11, the collecting unit 34 comprises an infrared distance measurement sensor 341 and a rotary steering gear 342 arranged coaxially;

wherein the collecting unit 34 is configured for: collecting information of distance between the monitoring node and an obstacle in front of the monitoring node by the infrared distance measurement sensor 342, when the rotary steering gear 341 rotates to different rotation angles;

the position determining unit 31 is further configured for generating the environmental data according to the rotation angle and the distance information.

In at least some of embodiments, the trace determining unit 33 is configured for: determining an outlet where the air humidifying device is close to the target region within the first region, according to the relative position information, if the region identifier of the target region is not the same as the region identifier of the first region where the monitoring node is located; taking a distance and a direction of the air humidifying device with respect to the outlet as the movement trace information.

Figure 12:
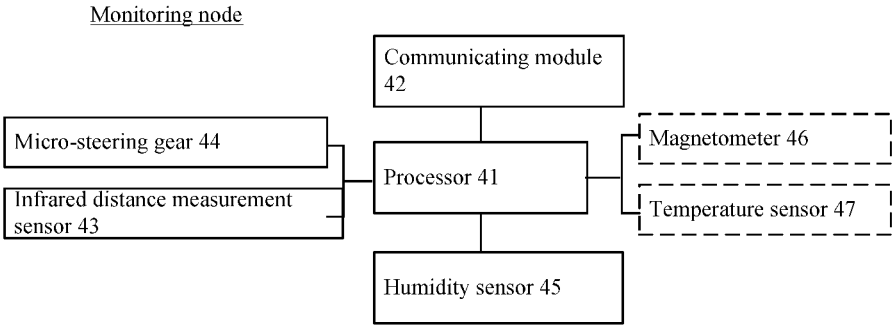
FIG. 12 is a schematic diagram of a hardware configuration of a monitoring node provided by an embodiment of the present disclosure.

Exemplarily, FIG. 12 is a hardware design solution of the monitoring node, wherein the monitoring node comprises:

a processor 41, for example, an Advanced RISC Machines (ARM) processor, for executing relevant functions of the position determining unit 31, the trace determining unit 33 and a recording unit 35 as described above;

a communicating module 42, for example, a ZigBee communicating module, for executing relevant functions of the above-described transmitting unit 32;

an infrared distance measurement sensor 43, for executing relevant functions of the above-described collecting unit 34;

a micro-steering gear 44, for driving the infrared distance measurement sensor 43 to rotate;

a humidity sensor 45, for monitoring humidity in the humidified region where the monitoring node is located.

Optionally, the air humidifying device may further comprise a hardware device such as a magnetometer 46 and a temperature sensor 47. For example, the magnetometer 46 may perform coordinate transformation on the position coordinate transmitted by the monitoring node, and the temperature sensor 47 may sense temperature within the humidified region where the monitoring node is located.

So far, the embodiments of the present disclosure provide an air humidifying device and a monitoring system for the air humidifying system. The air humidifying device can be guided to move towards the target region to be humidified, and then activate the humidification function, which can avoid a problem of limited humidified region in the prior art, and expand the scope of air humidification, so as to ensure humidity balance of the indoor air.

The foregoing embodiments merely are exemplary embodiments of the present disclosure, and not intended to define the scope of the present disclosure, and the scope of the present disclosure is determined by the appended claims.

This application claims priority of Chinese Patent Application No. 201610279989.3 filed on Apr. 28, 2016, the disclosure of which is incorporated herein by reference in its entirety as part of the present application.

The invention claimed is:

1. A method of moving an air humidifying device, comprising:

determining a target region, the target region being any one of N to-be-humidified regions, and N being an integer greater than or equal to 2;

determining movement trace information of the air humidifying device moving towards the target region;

moving the air humidifying device to the target region according to the movement trace information; and humidifying the target region, wherein a monitoring node is provided in each of the N to-be-humidified region, the monitoring node is configured for detecting humidity in the to-be-humidified region and transmitting the detected humidity to the air humidifying device, and the determining a target region comprises:

determining that the to-be-humidified region where the monitoring node is located is the target region to be humidified, if the detected humidity transmitted by the monitoring node is less than a humidity threshold.

2. The method according to claim 1, wherein the determining movement trace information of the air humidifying device moving towards the target region, comprises:

transmitting positioning instructions to N monitoring nodes, each of the positioning instructions carrying a region identifier of the target region;

receiving relative position information with respect to the air humidifying device transmitted by the N monitoring nodes;

determining one of the N monitoring nodes as a movement management node according to the relative position information; and receiving the movement trace information transmitted by the movement management node.

3. The method according to claim 2, wherein the determining one of the N monitoring nodes as a movement management node according to the relative position information, includes:

taking a monitoring node closest to the air humidifying device as the movement management node, according to the relative position information.

4. The method according to claim 2, wherein the movement trace information is configured for indicating an outlet within a first to-be-humidified region where the air humidifying device is close to the target region, the first to-be-humidified region being any one of the N to-be-humidified regions;

wherein the moving the air humidifying device to the target region according to the movement trace information, comprises:

moving the air humidifying device to arrives at the outlet, according to the movement trace information; and repeatedly executing the above steps, until the air humidifying device arrives at the target region.

5. The method according to claim 1, wherein the determining a target region, comprises:

receiving a humidification instruction, the humidification instruction comprising a region identifier of the target region; and determining the target region according to the region identifier of the target region.

6. An air humidifying device, comprising:

a determining unit, configured for determining a target region, and determining movement trace information of the air humidifying device moving towards the target region, the target region being any one of N to-be-humidified regions, and N being an integer greater than or equal to 2;

a moving unit, configured for moving the air humidifying device to the target region according to the movement trace information; and a humidifying unit, configured for humidifying the target region, wherein a monitoring node is provided in each of the N to-be-humidified regions the monitoring node is configured for detecting humidity in the to-be-humidified region and transmitting the detected humidity to the determining unit, and wherein the determining unit is further configured to determine that the to-be-humidified region where the monitoring node is located is the target region to be humidified, if the detected humidity transmitted by the monitoring node is less than a humidity threshold.

7. The air humidifying device according to claim 6, wherein the air humidifying device further comprises a transmitting unit and a receiving unit, wherein the transmitting unit is configured for transmitting positioning instructions to the N monitoring nodes, each of the positioning instructions carrying a region identifier of the target region;

the receiving unit is configured for receiving relative position information with respect to the air humidifying device transmitted by the N monitoring nodes, and receiving the movement trace information transmitted by the movement management node;

the determining unit is further configured for determining, according to relative position information, one of the N monitoring nodes as the movement management node.

8. The air humidifying device according to claim 7, wherein the determining unit takes a monitoring node closest to the air humidifying device as the movement management node.

9. The air humidifying device according to claim 7, wherein, the receiving unit is further configured for receiving a humidification instruction, the humidification instruction comprising the region identifier of the target region; and the determining unit is further configured for determining the target region according to the region identifier of the target region.

10. A monitoring system for an air humidifying system, wherein the air humidifying system comprises an air humidifying device, the monitoring system comprises N monitoring nodes, N being an integer greater than or equal to 2, each monitoring node comprising:

a position determining unit, configured for receiving a positioning instruction transmitted by the air humidifying device, and determining relative position information with respect to the air humidifying device, the positioning instruction carrying a region identifier of the target region;

a transmitting unit, configured for transmitting the relative position information to the air humidifying device, so that the air humidifying device, according to the relative position information, determines one of the N monitoring nodes as a movement management node; and transmitting the movement trace information to the air humidifying device;

a trace determining unit, configured for determining the movement trace information of the air humidifying device moving towards the target region, according to the region identifier of the target region and the relative position information, if the monitoring node is the movement management node.

11. The monitoring system according to claim 10, wherein, each of the monitoring nodes further comprises a collecting unit, and the collecting unit is configured for collecting environmental data within a first to-be-humidified region;

wherein the first monitoring node is located within the first to-be-humidified region;

the position determining unit extracts characteristic information of the air humidifying device from the environmental data, and determines relative position information between the first monitoring node and the air humidifying device, wherein characteristic information of the air humidifying device comprises an identification characteristic of the air humidifying device.

12. The monitoring system according to claim 11, wherein, the collecting unit comprises an infrared distance measurement sensor and a rotary steering gear arranged coaxially, the infrared distance measurement sensor is configured for collecting information of distance between the monitoring node and an obstacle in front of the monitoring node during the rotary steering gear is being rotated to different rotation angles;

the position determining unit generates the environmental data according to the rotation angle and the distance information.

13. The monitoring system according to claim 10, wherein, if the region identifier of the target region is not the same as the region identifier of the first to-be-humidified region where the monitoring node is located, the trace determining unit determines an outlet where the air humidifying device is close to the target region within the first to-be-humidified region, according to the relative position information; and takes a distance and a direction of the air humidifying device with respect to the outlet as the movement trace information.

14. An air humidifying system, comprising the air humidifying device according to claim 6, and a monitoring system, wherein the monitoring system comprises N monitoring nodes, N being an integer greater than or equal to 2, each monitoring node comprising:

a position determining unit, configured for receiving a positioning instruction transmitted by the air humidifying device, and determining relative position information with respect to the air humidifying device, the positioning instruction carrying a region identifier of the target region;

a transmitting unit, configured for transmitting the relative position information to the air humidifying device, so that the air humidifying device, according to the relative position information, determines one of the N monitoring nodes as a movement management node; and transmitting the movement trace information to the air humidifying device; and a trace determining unit, configured for determining the movement trace information of the air humidifying device moving towards the target region, according to the region identifier of the target region and the relative position information, if the monitoring node is the movement management node;

wherein the N monitoring nodes being respectively located in the N to-be-humidified regions.

15. The air humidifying system according to claim 14, further comprising:

a terminal device, configured for transmitting a humidification instruction to the air humidifying device, the humidification instruction comprising a region identifier of the target region.

16. A control method for the air humidifying system according to claim 14, comprising:

determining relative position information between the first monitoring node and the air humidifying device, if the first monitoring node receives the transmitted positioning instruction, the positioning instruction carrying the region identifier of the target region, the first monitoring node is any one of the N monitoring nodes;

transmitting the relative position information between the first monitoring node and the air humidifying device to the air humidifying device, and determining one of the N monitoring nodes as a movement management node, according to the relative position information;

determining movement trace information of the air humidifying device moving towards the target region, according to the region identifier of the target region and the relative position information, if the first monitoring node is the movement management node, and transmitting the movement trace information to the air humidifying device.

17. The method according to claim 16, wherein the determining relative position information between the first monitoring node and the air humidifying device, comprises:

collecting the environmental data within the first to-be-humidified region by the first monitoring node, the first monitoring node being located in the first to-be-humidified region;

determining relative position information between the first monitoring node and the air humidifying device according to the environmental data, if characteristic information of the air humidifying device is extracted from the environmental data, characteristic information of the air humidifying device comprising an identification characteristic of the air humidifying device.

18. The method according to claim 17, wherein the collecting the environmental data within the first to-be-humidified region by the first monitoring node, comprises:

collecting information of distance from an obstacle in front, at different rotation angles; and generating the environmental data according to the rotation angle and the distance information.

19. The method according to claim 16, wherein the determining the movement trace information of the air humidifying device moving towards the target region, according to the region identifier of the target region and the relative position information, comprises:

determining an outlet close to the target region within the first to-be-humidified region, according to the relative position information, if the region identifier of the target region is not the same as the region identifier of the first to-be-humidified region where the first monitoring node is located;

taking a distance and a direction of the air humidifying device with respect to the outlet as the movement trace information, so that the air humidifying device moves towards and arrives at the outlet according to the movement trace information, and determining the movement trace information of the air humidifying device moving towards the target region next time, until the air humidifying device arrives at target region.

20. The method according to claim 3, wherein the movement trace information is configured for indicating an outlet within a first to-be-humidified region where the air humidifying device is close to the target region, the first to-be-humidified region being any one of the N to-be-humidified regions;

wherein the moving the air humidifying device to the target region according to the movement trace information, comprises:

moving the air humidifying device to arrives at the outlet, according to the movement trace information; and repeatedly executing the above steps, until the air humidifying device arrives at the target region.

* * * * *